United States Patent [19]

Oda et al.

[11] Patent Number: 4,827,737

[45] Date of Patent: May 9, 1989

[54] COLD RESERVING APPARATUS

[75] Inventors: Yasukage Oda, No. 9-53, Hiyoshidai-Ichibancho, Takatsuki-shi, Osaka; Hiroshi Asami, Hiratsuka, both of Japan

[73] Assignees: Yasukage Oda, Takatsuki; Sumitomo Heavy Industries, Ltd., Tokyo, both of Japan

[21] Appl. No.: 234,408

[22] Filed: Aug. 19, 1988

[30] Foreign Application Priority Data

Aug. 27, 1987 [JP] Japan ..... 62-213331

[51] Int. Cl.[4] ..... F25B 19/00

[52] U.S. Cl. ..... 62/51.3; 62/78; 62/383

[58] Field of Search ..... 62/78, 383, 514 R

[56] References Cited

U.S. PATENT DOCUMENTS

| | | | |
|---|---|---|---|
| 3,871,107 | 3/1975 | Broadwin | 62/384 |
| 4,223,540 | 9/1980 | Longsworth | 62/514 R |
| 4,601,040 | 7/1986 | Andrews et al. | 62/514 R |
| 4,658,601 | 4/1987 | Burchell et al. | 62/514 R |
| 4,689,970 | 9/1987 | Ohguma et al. | 62/514 R |

*Primary Examiner*—Ronald C. Capossela

*Attorney, Agent, or Firm*—Flynn, Thiel, Boutell & Tanis

[57] ABSTRACT

A cold reserving apparatus having a specimen accommodation chamber capable of being closed and inserted and disposed in a vacuum vessel. A cooling stage of the refrigerator is inserted into this vacuum vessel, and a cooling stage provided on the specimen accommodation chamber in the vacuum vessel and the cooling stage of the refrigerator are connected by a solid heat-conductive material.

4 Claims, 2 Drawing Sheets

COLD RESERVING APPARATUS

BACKGROUND OF THE INVENTION

This invention relates to an apparatus used to maintain a specimen at a low temperature for a long period of time and, more particularly, to a cold reserving apparatus used for refrigeration storage of livestock spermatozoa, measurement of critical temperatures of superconductors, storage of liquid nitrogen, and so forth.

A method of freezing spermatozoa in a suitable vessel by liquid nitrogen is known as one of simplest methods of refrigeration storage of spermatozoa factitiously taken from a livestock such as a bull. To lengthen the term of refrigeration storage based on this method, it is necessary to perform troublesome operations of periodically replenishing liquid nitrogen to maitain a desired low temperature. In the field of superconducting material, it is indispensable to measure the critical temperature of a newly developed superconducting material. One example of generally used conventional apparatus for measuring critical temperatures has a construction in which a specimen accommodation chamber is disposed in an adiabatic vacuum in a position adjacent to a cooling stage of a Gifford-McMahon refrigerator or an improved type thereof. In another example, a refrigeration chamber in which liquid nitrogen or liquid helium is contained and a specimen accommodation chamber disposed under the refrigeration chamber adjacently thereto are provided in a vacuum vessel. In both these temperature test apparatus, the capacity of the specimen accommodation chamber cannot be increased beyond a limit which is determined in relation to the size of the refrigerator or refrigerant container adjacent to the specimen accommodation chamber. In addition, the adiabatic vacuum is necessarily lost each time a specimen is replaced. At the same time, the operation of the refrigerator must be stopped in the case of the former type of apparatus. Therefore, a low-temperature atmosphere in a specimen chamber formed in the process of the preceding test cannot be maintained and used for the succeeding test, as the temperature of the specimen chamber is returned to the room temperature at the time of replacement of a specimen.

SUMMARY OF THE INVENTION

It is therefore an object of the present invention to provide a cold reserving apparatus which is capable of maintaining a low temperature such as that can be obtained by liquid nitrogen for a comparatively long time.

It is another object of the present invention to provide a cold reserving apparatus which can also be used to measure critical temperatures of superconducting materials.

To these ends, the present invention provides a cold reserving apparatus in which a specimen accommodation chamber capable of being closed is inserted and disposed in a vacuum vessel; a cooling stage of a refrigerator is inserted into said vacuum vessel; and a cooling stage provided on the specimen accommodation chamber disposed in the vacuum vessel and the cooling stage of the refrigerator are connected by a solid member made of a heat-conductive material. This connecting member is not necessarily a rigid body.

More specially, the cold serving apparatus in accordance with the present invention comprises: (a) a vacuum vessel; (b) a specimen accommodation chamber whose greater part is inserted in the vacuum vessel, said accommodation chamber having a cooling stage being attached to a side wall portion of said accommodation chamber and also having an opening exposed outside the vacuum vessel, said opening being provided with a lid capable of being opened or closed; (c) a refrigerator having a cooling stage positioned inside the vacuum vessel; and (d) a solid member made of a heat-conductive material and connecting the cooling stage attached to the specimen accommodation chamber and the cooling stage of the refrigerator to each other.

These and other objects and features of the present invention will become clear upon reading the following description.

DESCRIPTION OF THE PREFERRED EMBODIMENT

Figure 1:
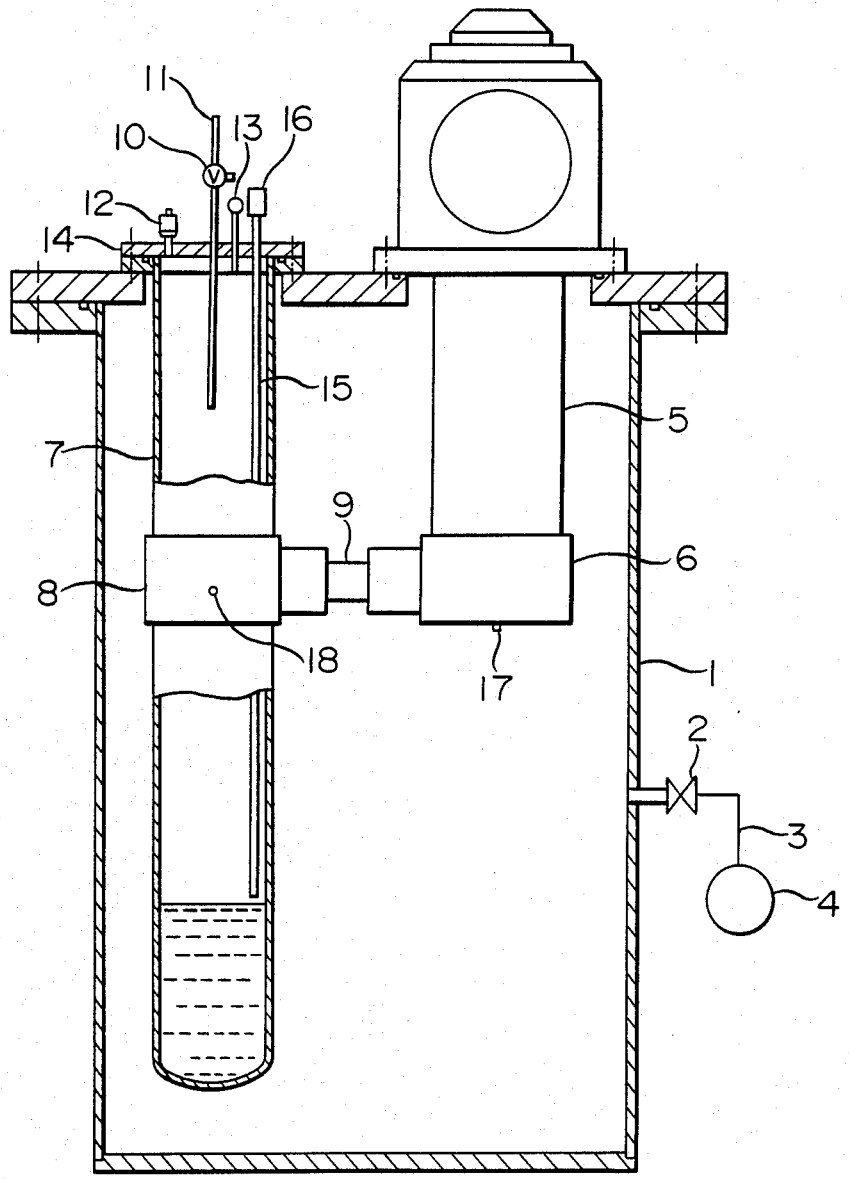
FIG. 1 is a cross-sectional view of a cold reserving apparatus in accordance with the present invention.

Referring to FIG. 1, a vacuum pump 4 is connected to a vacuum vessel 1 by a conduit 3 via a valve 2. A refrigerator 5 using, for example, the Gifford-McMahon cycle is inserted into the vacuum vessel 1 so that a cooling stage 6 is positioned inside the vacuum vessel 1. A specimen chamber 7 is typically a cylindrical receptacle opened at its top and closed at its bottom. The whole of the specimen chamber 7 is inserted and accommodated in the vacuum vessel 1. A cooling stage 8 is provided on an longitudinal-intermediate portion of the specimen chamber 7. The cooling stage 8 and the cooling stage 6 are connected to each other by a member 9 made of a substance superior in heat conductivity, e.g., copper. A lid 14 of the specimen chamber 7 can be provided, as desired, with a gas conduit 11 having three-way cock 10, a safety valve 12, a pressure gauge 13, a liquid extracting tube 15 having a cap 16, and so forth. Thermometers 17 and 18 are respectively provided on the cooling stage 6 of the refrigerator 6 and the cooling stage 8 provided on the specimen accommodation chamber 7.

To use the cold reserving apparatus in accordance with the present invention, the vacuum pump 4 is first operated so that, typically, the internal pressure of the vacuum vessel 1 is maintained at $5\times10^{-2}$ Torr during the operation of the refrigerator 5. The lowest attainable temperature of the cooling stage 6 depends on the type of the refrigerator 5. For example, the lowest temperature of a single-stage helium refrigerator is about 40K and that of a two-stage helium refrigerator is about 10K. If the latter type of refrigerator is used, the specimen chamber 7 can be maintained at a desired temperature higher than about 15K. The arrangement shown in FIG. 1 is designed to contain liquid nitrogen for a long period of time. It is possible for the cold reserving apparatus of the present invention to maintain the cooling stage 8 on the specimen chamber 7 at 70 to 77K by controlling the refrigerator and also possible to maintain the vapor phase region in the accommodation chamber 7 as a nitrogen gas atmosphere at 1 atm. Liquid nitrogen can therefore be kept within the specimen chamber 7 unless the operation of the refrigerator is stopped by accident. Frozen livestock spermatozoa, for example, may be accommodated in place of liquid nitrogen in the specimen accommodation chamber 7 and kept for a long period of time as in the case of liquid nitrogen.

The cold reserving apparatus of the present invention can also be used as an apparatus for liquidizing air, nitrogen or hydrogen. Liquefaction of nitrogen is effected as described below. The specimen accommodation chamber 7 is charged with nitrogen gas to displace air, the operation of the refrigerator is then started. After the cooling stage 8 on the accommodation chamber 7 has been cooled at a temperature equal to or lower than 77K, nitrogen gas in the chamber is condensed and liquidized. As the liquefaction proceeds, the pressure of nitrogen gas in the chamber decreases and additional nitrogen gas is supplied at a controlled rate to the interior of the accommodation chamber via the gas conduit 11 so that the pressure inside the chamber is maintained at 1 atm. The pressure inside the chamber is observed by means of the pressure gauge 13. Liquid nitrogen in the accommodation chamber can be taken out via the liquid extracting tube 15.

Figure 2:
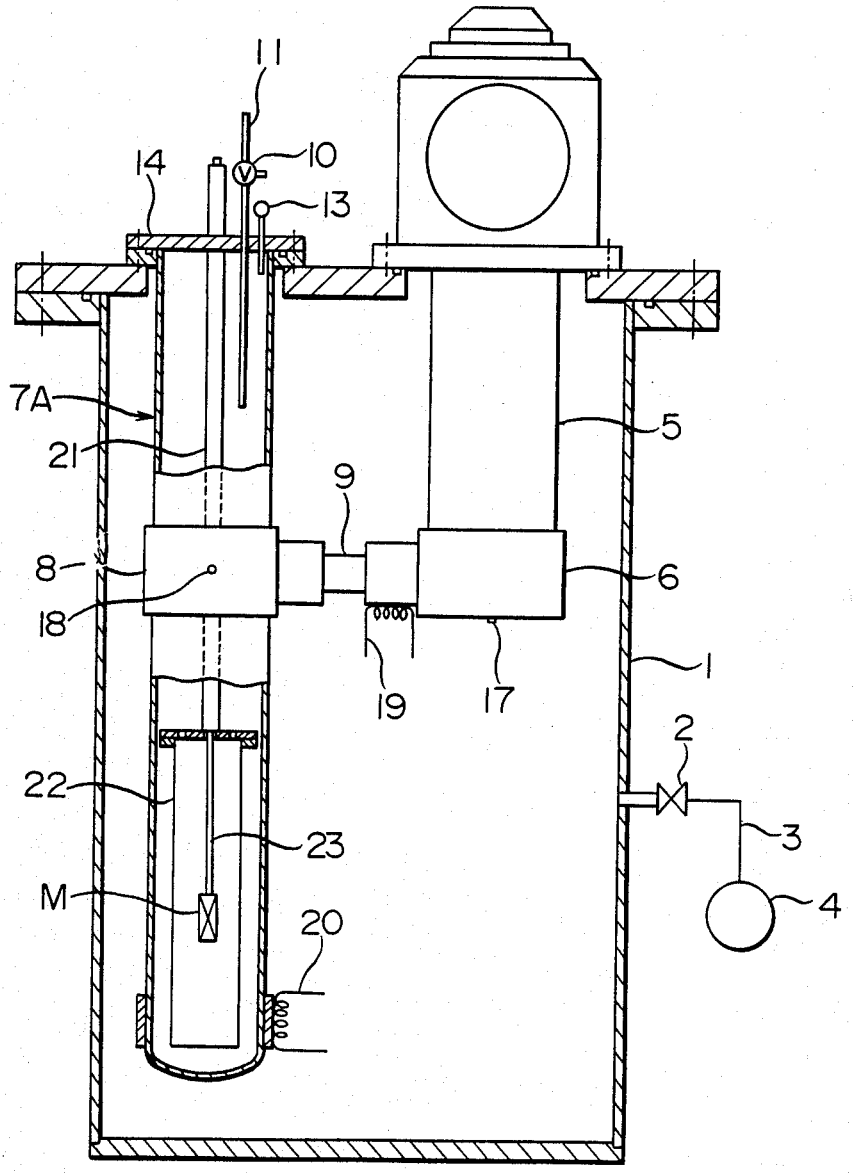
FIG. 2 is a cross sectional view of the application of the cold reserving apparatus of the present invention to a critical temperature measuring apparatus using a test piece M.

The cold reserving apparatus of the present invention can also be used as an apparatus for measuring critical temperatures of superconducting materials. FIG. 2 shows in section an example of a state of this kind of use. In FIG. 2, portions identical to those shown in FIG. 1 are indicated by the same reference characters. Thermometers 17 and 18 are respectively disposed on the cooling stage 6 of the refrigerator 5 and the cooling stage 8 provided on a specimen accommodation chamber 7A. A temperature controlling heater 19 is attached to the heat-conductive member 9 that connects these stages, and another temperature controlling heater 20 is attached to a bottom portion of the accommodation chamber 7. A receptacle 22 which is capable of being inserted into and drawn out of the specimen accommodation chamber is suspended in a lower portion of the accommodation chamber 7A by a support pipe 21 which passes through the lid 14. A material M to be tested is disposed inside the receptacle 22 by a support rod 23. In the thus-constructed apparatus, the test material M is cooled by heat conduction to, for example, a helium gas which is supplied via the gas conduit 11 and enclosed in the accommodation chamber 7A and which is cooled by the cooling stage 8. The temperature at which the test material M is cooled is controlled by monitoring the thermometers 17 and 18 and changing the rate of heat transfer from the cooling stage 6 of the refrigerator as well as the temperature of the gas inside the accommodation chamber 7A by using the heaters 19 and 20.

What is claimed is:

1. A cold serving apparatus comprising:

(a) a vacuum vessel;

(b) a specimen accommodation chamber whose greater part is inserted in said vacuum vessel, said accommodation chamber having a cooling stage being attached to a side wall portion of said accommodation chamber and also having an opening exposed outside said vacuum vessel, said opening being provided with a lid capable of being opened or closed;

(c) a refrigerator having a cooling stage positioned inside said vacuum vessel; and (d) a solid member made of a heat-conductive material and connecting said cooling stage attached to said specimen accommodation chamber and said cooling stage of said refrigerator to each other.

2. A cold reserving apparatus according to claim 1, wherein said refrigerator is a single-stage helium refrigerator.

3. A cold reserving apparatus according to claim 1, wherein said refrigerator is a two-stage helium refrigerator.

4. A cold reserving apparatus according to claim 1, further comprising a gas conduit for charging or discharging a gas into or from said specimen accommodation chamber, and a liquid conduit for charging or discharging a liquid into or from said accommodation chamber.

* * * * *